US005535568A

United States Patent [19]

Quinn

[11] Patent Number: 5,535,568

[45] Date of Patent: Jul. 16, 1996

[54] SELF INDEXING LANDSCAPE MODULE

[76] Inventor: Martin J. Quinn, R.R. #1 Box 232, Mohawk, N.Y. 13407

[21] Appl. No.: 335,066

[22] Filed: Nov. 7, 1994

[51] Int. Cl.[6] ..... E04C 2/04

[52] U.S. Cl. ..... 52/608; 52/604; 52/606; 405/284

[58] Field of Search ..... 52/562, 589.1, 52/585.1, 592.6, 592.5, 596, 597, 604, 608, 606; 405/284, 285, 286; 47/82, 83

[56] References Cited

U.S. PATENT DOCUMENTS

| | | | |
|---|---|---|---|
| 2,688,245 | 9/1954 | Vesper | 52/592.5 |
| 4,229,123 | 10/1980 | Heinzmann | 405/273 |
| 4,278,364 | 7/1981 | Frehner | 405/273 |
| 4,312,606 | 1/1982 | Sarikelle | 405/286 |
| 4,496,266 | 1/1985 | Ruckruhl | 404/41 |
| 4,524,551 | 1/1985 | Scheiwiller | 52/98 |
| 4,543,745 | 10/1985 | Beck | 47/33 |
| 4,570,812 | 2/1986 | Curtis | 220/1 T |
| 4,601,148 | 7/1986 | Risi et al. | 52/284 |
| 4,798,499 | 1/1989 | Yamada | 405/286 |
| 4,802,320 | 2/1989 | Forsberg | 52/585 |
| 4,815,897 | 3/1989 | Risi et al. | 405/284 |
| 4,825,619 | 5/1989 | Forsberg | 52/562 |
| 4,834,585 | 5/1989 | Hasenwinkle et al. | 405/286 |
| 4,858,378 | 8/1989 | Helmy | 47/33 |
| 5,129,627 | 7/1992 | Mongeau | 256/19 |
| 5,157,867 | 10/1992 | Fritch | 47/33 |
| 5,168,678 | 12/1992 | Scott, Jr. et al. | 52/102 |
| 5,233,806 | 8/1993 | Hightower et al. | 52/561 |
| 5,248,226 | 9/1993 | Risi et al. | 405/284 |
| 5,259,154 | 11/1993 | Lilley | 47/33 |
| 5,277,012 | 1/1994 | Woolbright | 52/589 |
| 5,294,216 | 3/1994 | Sievert | 405/286 |

*Primary Examiner*—Carl D. Friedman
*Assistant Examiner*—David J. Jersen
*Attorney, Agent, or Firm*—Daniel S. Kalka; Vytas R. Matas

[57] ABSTRACT

A landscape module includes a plurality of projections at predetermined intervals positioned around the periphery of the back and sidewalls to index modules when they are stacked. The landscape module is constructed to be filled with fill material such as dirt, gravel, sand, etc. It is lightweight and has an imitation concrete front. The preferred embodiment has sidewalls which include a first and second part with the projections only being on the underside of the second part of the sidewall and the back wall.

13 Claims, 4 Drawing Sheets

SELF INDEXING LANDSCAPE MODULE

BACKGROUND OF THE INVENTION

1. Field of the Invention

The present invention relates, in general, to a landscape module, and in particular to a self indexing landscape module which is lightweight and constructed to be filled with any suitable landscape material.

2. Description of the Related Art

There are a variety of materials which are normally used in landscaping such as fences, logs, railroad ties, bricks, concrete blocks, and the like to provide a decorative edge for a lawn or garden. They also may be used to establish a terrace, a retaining wall, surround a tree, or even contain mulch for a flower area.

There are many different styles of retaining blocks which are composite or concrete blocks used to make a retaining wall, for example, U.S. Pat. Nos. 5,277,012; 5,233,806; 4,802,320; 4,825,619; 4,496,266; 4,920,712; 5,017,049; and 5,062,610 show various styles of retaining blocks.

Also, interlocking or interengaging "beam-type" retaining wall systems are well known in this art, such as, U.S. Pat. Nos. 5,168,678; 4,524,551; 4,312,606; 4,278,364; 4,815,897; and 4,490,075.

U.S. Pat. Nos. 4,601,148 and 4,229,123 describe several forms of hollow blocks useful for a retaining wall. U.S. Pat. No. 5,294,126 discloses an aesthetically pleasing composite masonry block in FIG. 4 also useful for a retaining wall.

A need still exists for a hollow landscape block that is aesthetically pleasing which can be used in a retaining wall or to accommodate any terrace. Preferably, the block or module would find use as a planter and provide means for easily indexing or aligning the modules to accommodate a gradual or steep slope when terracing. The modules would be cheaper, lighter, and easier to work with than masonry blocks.

SUMMARY OF THE INVENTION

The present invention is directed to solving the aforementioned problems with the prior art as well as others by providing a landscape module that is hollow and can be filled on site with any suitable material. The landscape module of the present invention includes means for aligning and indexing which engage another landscape module to allow for a precise and accurate adjustable angle when terracing steep or gradual slopes.

One aspect of the present invention is to provide a landscape module which is light in weight, yet can be used to construct a retaining wall, flower bed, tree ring, etc.

Another aspect of the present invention is to provide a landscape module which includes a plurality of projections spaced in a predetermined manner on its underside to engage another landscape module to allow accurate and easy alignment with an adjustable angle to facilitate building a retaining wall or terracing a steep or gradual slope.

Still another aspect of the present invention is to provide a self indexing landscape module which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by it uses, reference is made to the accompanying drawings and descriptive matter in which the preferred embodiment of the invention is illustrated.

DESCRIPTION OF THE PREFERRED EMBODIMENTS

Figure 1:
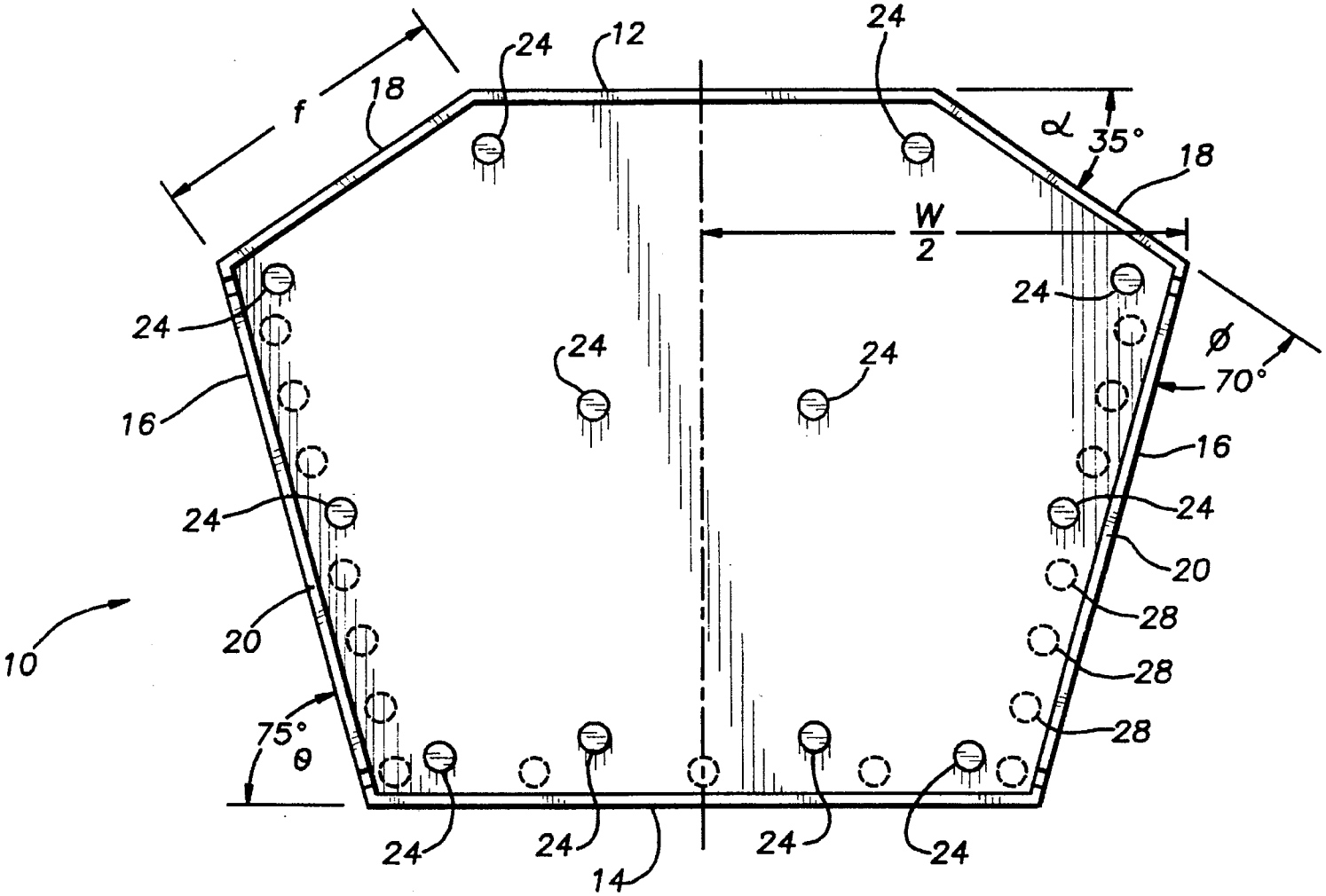
FIG. 1 is a top view of the present invention.

Referring to the Figures where like numerals designate like or similar features throughout the several views, and in particular to FIG. 1, the present invention resides in a self indexing landscape module generally depicted 10. The landscape module 10 has a front wall 12, a back wall 14, and a pair of sidewalls 16. Each sidewall 16 in the preferred embodiment has a first part 18 connected to the front wall 12 at an angle a with respect to the front wall which is less than 90 degrees and preferably about 35 degrees. Each sidewall 16 also has a second part 20 connected to the back wall at a second angle θ which is less than 90 degrees with respect to the back wall and preferably is about 75 degrees. The first part 18 is connected to the second part 20 of each sidewall 16 at an angle ϕ which is less than 90 degrees with respect to the first part 18 and preferably is about 70 degrees.

A bottom panel or floor 22 connects the front wall 12, back wall 14, and sidewalls 16 to define a space for receiving any suitable fill material including but not limited to dirt, gravel, stones, etc. The bottom panel 22 has a plurality of openings or apertures 24 which act to drain water from the module, but may also be used for an anchor to hold the landscape module in place.

Figure 3:
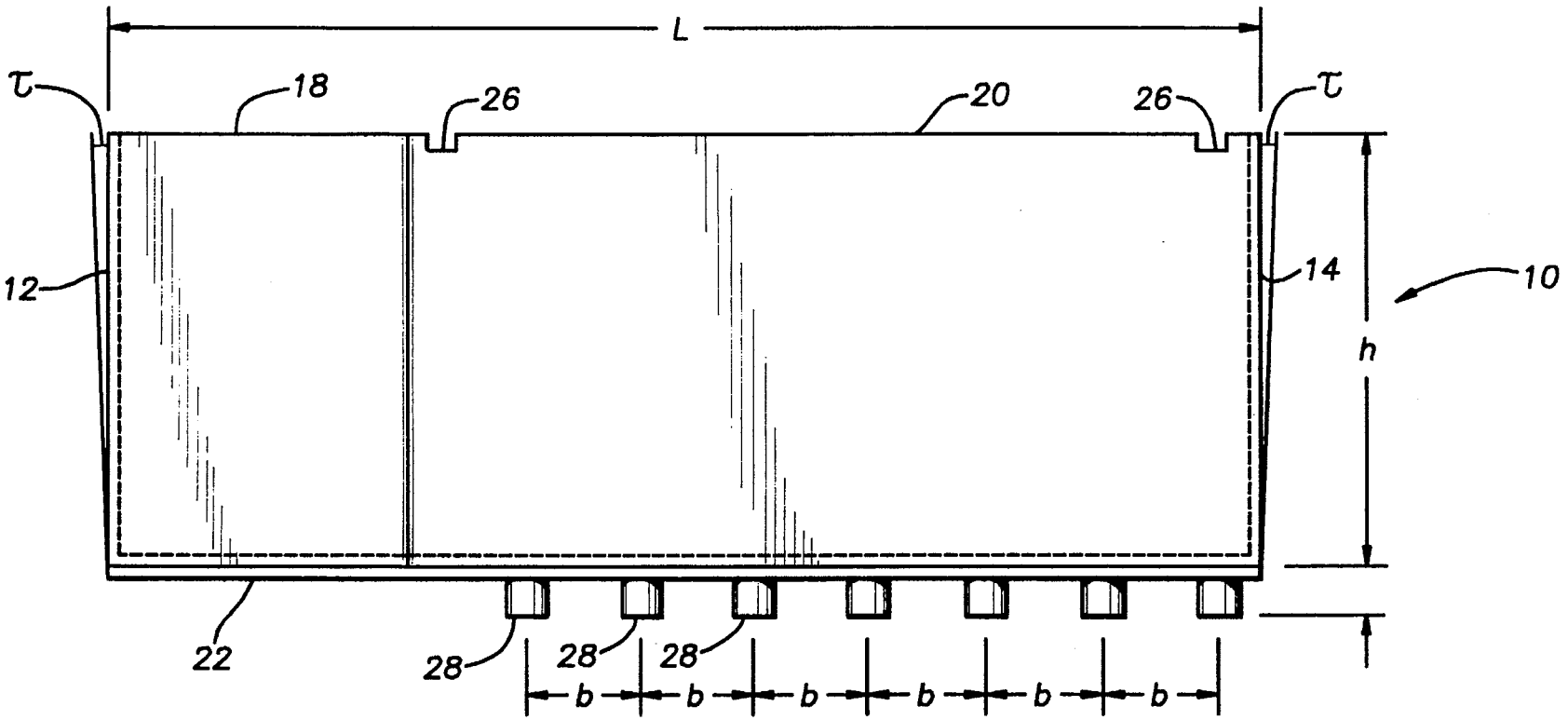
FIG. 3 is a side elevational view of the present invention.

Referring now to FIG. 3, the second part 20 of the sidewalls 16 have recesses 26 at the four corners of their top edge which are constructed to receive a clip to hold two landscape modules 10 together. On the underside of the bottom panel 22 is a plurality of projections 28 that are spaced at predetermined intervals. Projections 28 are preferably cylindrical and protrude preferably about ⅜ inch, however, they may include any shape and/or length. Projections 28 are positioned around the periphery of the underside of the landscape module 10 and in particular around the edge of the second part 20 of the sidewalls 16 with a spacing b of about one inch. The spacing of the projections 28 on the underside around the edge of the back wall 14 is about two inches. Of course, the projections may have any predetermined spacing and can be positioned on the front or the first part of the sidewalls as well.

Figure 2:
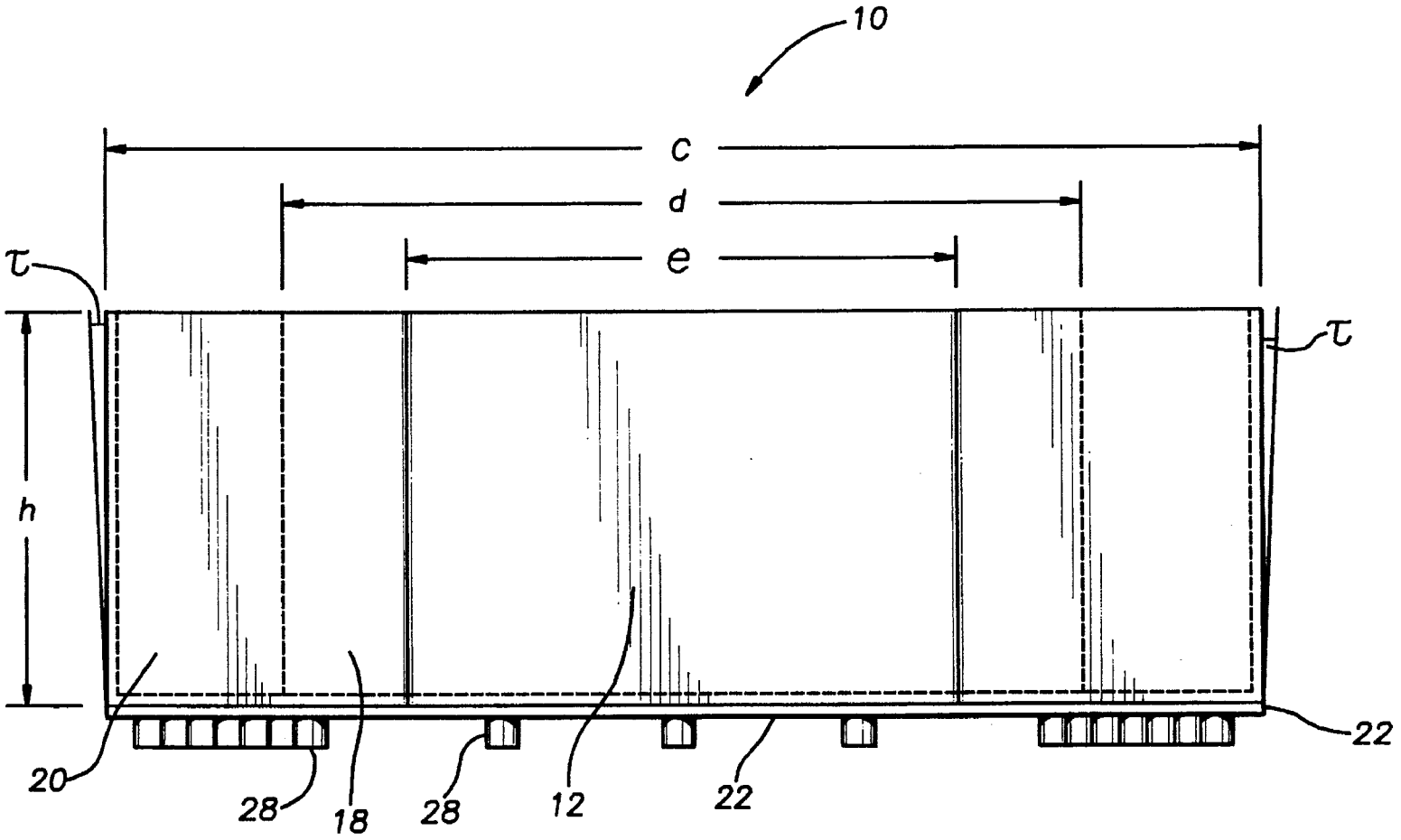
FIG. 2 is a front elevational view of the present invention.

Referring back to FIG. 2, the landscape module 10 is preferably fabricated with all of the walls having an inward taper at an angle r of about 1.5 degrees. In the preferred embodiment, the dimensions of the landscape module are as follows: the maximum width c is about twelve inches at its widest point; the length d of the back wall 14 is about eight and a half inches; the length e of the front wall 12 is about six inches; the height h is about four inches; the length f of the first part 18 of each sidewall 16 is about three and three-fourths inches; the overall length L of the landscape module is about nine inches; and the center line of each unit is w/2 which is about six inches. The thickness of the walls are preferably from about 0.090–0.100 inches. The diameter of the projections are about ⅜ inches and the diameter of each opening 24 is about ⅜ inch.

The preferred method of making the landscape module 10 of the present invention is to injection mold the module in one piece from a plastic material preferably recycled high density polyethylene. It can be made from any other suitable material. An imitation concrete front is molded in to the module. If desired, the imitation concrete front can be molded in to all of the walls. The walls can be given any surface treatment for aesthetic purposes.

Another method for fabricating the landscape module is to cut a sheet of plastic material in the selected form and bend the cut corners and fasten them together to form the module.

Figure 4:
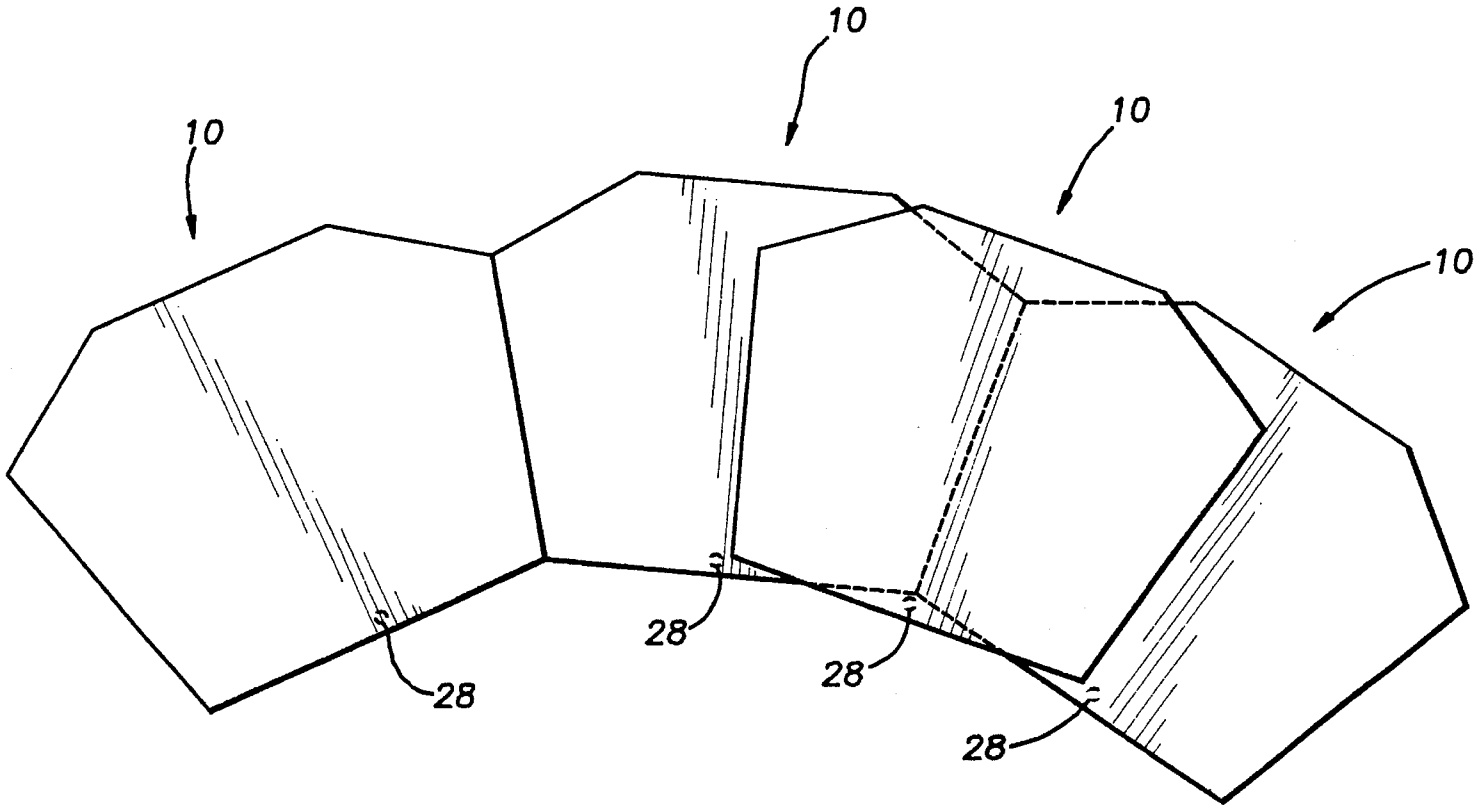
FIG. 4 is a top view schematic of several landscape modules according to the present invention illustrating the use of the center indexing pin to precisely align a stacked configuration for a landscape requiring a short diameter.

As best seen in FIGS. 1 and 4, there is a projection 28 (shown in phantom line in FIG. 1) that is positioned right on the center line of the landscape module. This center indexing pin provides means for simple, accurate alignment of the modules in a stacked arrangement for short diameters. The projections 28 provide indexing means for stacking the modules when building a retaining wall or terracing a steep or even a gradual slope. When terraced, the modules can serve the additional function of acting as a planter for flowers, etc. As an example for illustrative purposes only, one indexing pin 28 positioned outside and engaging the next stacked module produces a retaining wall with an incline of approximately 80 degrees. Similarly, three indexing pins positioned outside and stacked on an earlier laid module produces a more gradual grading of approximately 55 degrees. The landscape modules of the present invention may be laid in a straight line, curved line, almost straight up and down, or gradually terraced back at any steepness. They may be used for lawn edging, tree rings, circle for compost piles, retaining walls, flower beds or borders, terrace walls, or even as individual planters.

While a specific embodiment of the invention has been shown and described in detail to illustrate the application of the principles of the invention, it will be understood that the invention may be embodied otherwise without departing from such principles. For example, while the invention is particularly described with respect to one shape, the plurality of projections and their location is equally applicable to any shape having four walls and a floor.

What is claimed is:

1. A landscape module, comprising:

a front wall;

a back wall;

a sidewall connected to each end of said front wall and back wall, a first part of each of said sidewalls connected to said front wall at an angle $\alpha$ which is less than about 90 degrees, a second part of each of said sidewalls connected to said back wall at a second angle $\theta$ different from said angle $\alpha$ and being less than about 90 degrees, said second part of each of said sidewalls being connected to said first part of each of said sidewalls;

a bottom panel connecting said front, back, and sidewalls together to define a space for receiving fill material, said bottom panel having a plurality of apertures therethrough; and a plurality of cylindrical projections positioned at predetermined intervals on an underside of said bottom panel for indexing a landscape module when stacked, said plurality of cylindrical projections being positioned around a periphery on the underside of said bottom panel of said back wall and said second part of each sidewall, one of said cylindrical projections being positioned on a center line of the landscape module for aligning each landscape module in a stacked arrangement, all of said walls, said bottom panel and said cylindrical projections being plastic.

2. A landscape module as recited in claim 1, wherein each projection on the underside of said bottom panel around the periphery of said second part of each sidewall is spaced about one inch apart.

3. A landscape module as recited in claim 1, wherein each wall tapers inwardly at an angle $\tau$.

4. A landscape module as recited in claim 3, wherein said angle $\tau$ is about 1.5 degrees.

5. A landscape module as recited in claim 1, wherein the plastic is polyethylene.

6. A landscape module as recited in claim 1, wherein said front wall includes an imitation concrete appearance.

7. A landscape module as recited in claim 1, wherein said plurality of cylindrical projections act as indexing pins when landscape modules are stacked.

8. A landscape module as recited in claim 1, wherein said plurality of apertures in said bottom panel are positioned around an outer edge of said bottom panel.

9. A landscape module as recited in claim 1, wherein said angle $\alpha$ is about 35 degrees.

10. A landscape module as recited in claim 1, wherein said second angle $\theta$ is about 75 degrees.

11. A landscape module as recited in claim 1, wherein the landscape module is injection molded.

12. A landscape module as recited in claim 1, wherein each projection on the underside of said bottom panel positioned on the periphery of said back wall is spaced about two inches apart.

13. A landscape module as recited in claim 12, wherein each projection on the periphery of the underside of said bottom panel positioned on the periphery of said second part of each of said sidewalls is spaced about one inch apart.

* * * * *